US006332816B1

(12) United States Patent
Tsuchiya et al.

(10) Patent No.: US 6,332,816 B1
(45) Date of Patent: Dec. 25, 2001

(54) JET-PROPELLED BOAT

(75) Inventors: Masahiko Tsuchiya; Tomohisa Abe, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/598,951

(22) Filed: Jun. 22, 2000

(30) Foreign Application Priority Data

Jun. 22, 1999 (JP) ..... 11-175296

(51) Int. Cl.[7] ..... B63H 11/113; B63H 11/107
(52) U.S. Cl. ..... 440/40; 114/162; 440/42
(58) Field of Search ..... 440/38, 40–43; 114/162, 166

(56) References Cited

U.S. PATENT DOCUMENTS 2,369,279 * 2/1945 Carnaghan et al. ..... 114/166
3,302,605 * 2/1967 Kuether ..... 440/42
3,949,700 * 4/1976 Baroody .
5,167,547 * 12/1992 Kobayashi et al. .

FOREIGN PATENT DOCUMENTS 5-162689-A * 6/1993 (JP) ..... 440/43

OTHER PUBLICATIONS

Abstract of Japanese Patent Application Hei–5–162689 dated Jun. 29, 1993.

* cited by examiner

*Primary Examiner*—Sherman Basinger

(57) ABSTRACT

In a jet-propelled boat, a nozzle of a jet pump is constructed so as to be rotatable in response to steering by a rider of the boat in order to change a course of the boat. A rudder, that does not project downwards further than a boat bottom, is attached to an outer surface of the nozzle. A jet pump channel is provided for guiding a water flow to the jet pump. A rudder channel is provided separate from the jet pump channel and guides a water flow to the rudder. When a driving speed of the jet pump is stopped or slowed, the rudder will enable the course of the boat to be steered when the boat continues to move through the water due to its own inertia. The steering occurs because the direction of the nozzle and hence the rudder can be controlled by the boat's rider, and water will continue to be delivered to the rudder via the rudder channel. The rudder may be duct-shaped. Further, a plate may be provided to selective block an inlet of the rudder channel, with the plate opening the rudder channel when a driving speed of the jet pump is a prescribed value or less.

20 Claims, 5 Drawing Sheets

JET-PROPELLED BOAT

BACKGROUND OF THE INVENTION

1. Field of the Invention

The present invention relates to a jet-propelled boat, equipped with a jet pump with a rotatable nozzle as a means of propulsion. The present invention more specifically relates to a jet-propelled boat, which is able to change course even when the jet stream from a jet pump is stopped or weak.

2. Description of the Relevant Art

Jet-propelled boats are well known, such as in Japanese Patent Laid-open Publication No. Hei. 5-162689. As shown in FIG. 5, a boat 1, in accordance with the background art, is equipped with an engine 3 mounted within a boat body 2. A jet pump 3*a* is driven by the engine 3. A nozzle 5 that can be rotated right or left, via a pair of upper and lower pins 6, is provided at a jet opening 4 of the jet pump 3*a*.

A rudder 8 is provided at a shaft 9 at a rear part of the nozzle 5. The nozzle 5 is connected to handlebars 7 using a steering wire (not shown) and is rotated by operating the handlebars, so that the rudder 8 and the nozzle 5 rotate together.

According to this jet-propulsion boat, the course can be changed while the boat is being propelled by a jet stream from the jet pump 3*a* by rotating the nozzle 5 so as to change the direction of the jet stream. When the boat's engine is either stopped or decelerating, the jet stream of the jet pump is stopped or is weak. Even so, the course of the boat 1 can be changed using the rudder 8, while the boat is advancing as a result of its own inertia. If the rudder 8 is not provided with this type of jet-propelled boat, the course cannot be changed when the boat is travelling under its own inertia. Therefore, the rudder 8 is advantageous in allowing steering of the boat when the boat's engine is either stopped or decelerating.

With the jet-propelled boat of FIG. 5, the construction is such that the course of the boat is changed by changing the direction of a water flow W moving along the boat bottom 2*a* using the rudder 8. Therefore, in accordance with the background art, a lower end 8*a* of the rudder 8 must project further downwards than the boat bottom 2*a*, in order to function as a rudder. This results in a requirement that the boat not be used in shallow water, since the rudder 8 could be damaged upon contact with the water's bottom. When the center of rudder force and the rudder shaft become separated, the steering force required for the rudder to be effective increases dramatically.

SUMMARY OF THE INVENTION

In order to resolve the aforementioned problems, it is an object of the present invention to provide a jet-propelled boat capable of changing course, when the jet stream of the jet pump is halted or weak, and the boat continues to move under its own inertia.

It is a further object of the present invention to provide a jet-propelled boat with a rudder which does not project below a bottom of the boat, so that the rudder is protected in shallow waters.

It is yet a further object of the present invention to provide a jet-propelled boat with a rudder which is activated when a driving speed of the jet pump is less than a predetermined value.

It is yet a further object of the present invention to provide a jet-propelled boat with an improved rudder design, such as a duct shaped rudder.

It is yet a further object of the present invention to provide a jet-propelled boat with a plate which is deployed from a lower portion of the boat's hull when the driving speed of the jet pump is less than a predetermined value, with the plate acting to slow the forward motion of the boat.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing)s which are liven by way of illustration only, and thus, are not limitative of the present invention, and wherein:

FIG. 3(*b*) is a perspective view of a nozzle, in accordance with a second embodiment of the present invention;

FIG. 5(*b*) is a perspective view of a nozzle and rudder, in accordance with the background art.

DETAILED DESCRIPTION OF THE INVENTION

Figure 1:
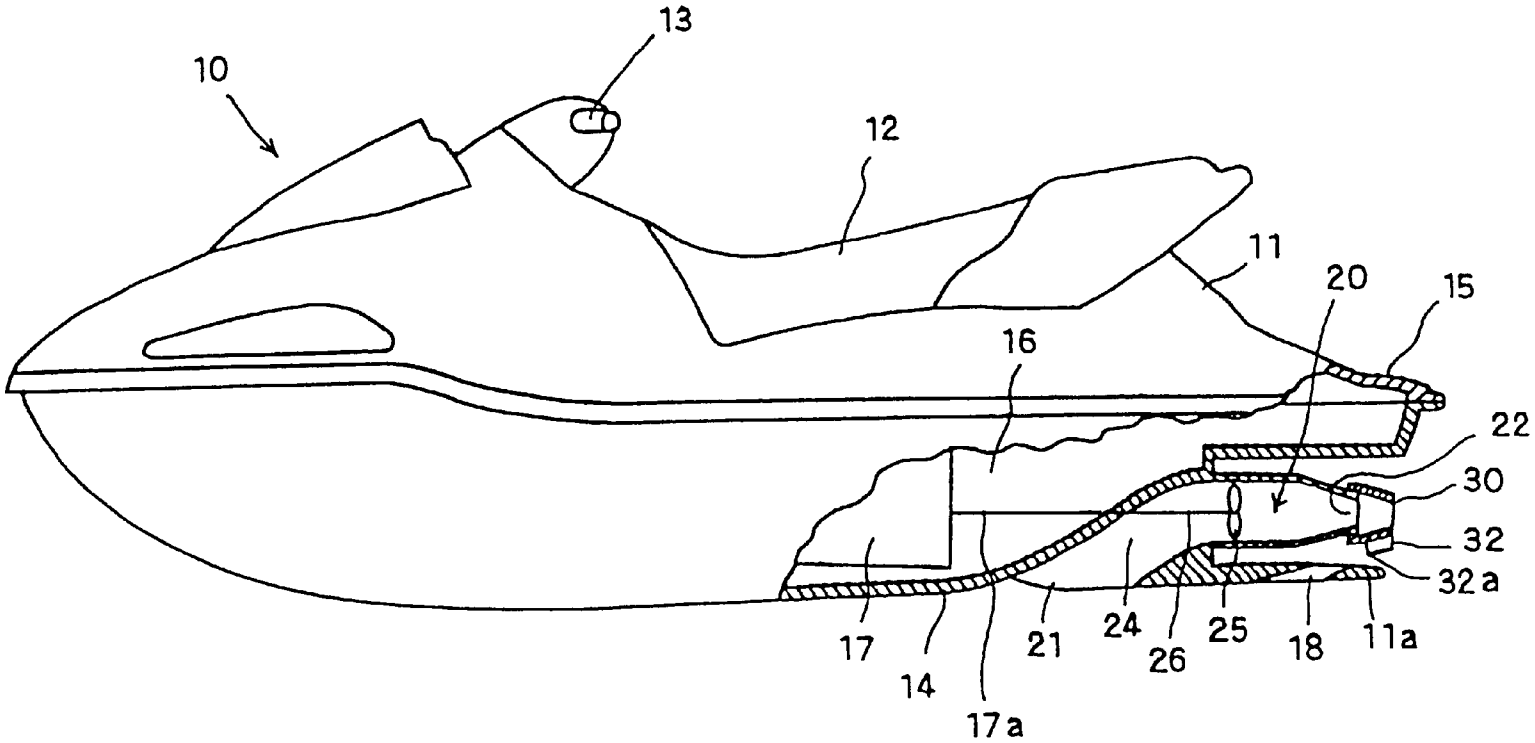
FIG. 1 is a partially cut-away, side view of a jet-propelled boat, in accordance with a first embodiment of the present invention.

As shown in FIG. 1, a jet-propelled boat 10 is a saddle-ridden small boat, where a rider sits on a seat 12 on a boat hull or body 11. The rider steers the jet-propelled boat 10 using a steering handlebar 13 with a throttle grip.

The boat body 11 is a floating structure where a space 16 is formed within a joined lower hull panel 14 and upper hull panel 15. An engine 17 is mounted on the lower hull panel 14, within the space 16. The engine 17 drives a jet pump 20 to propel the boat 10. The jet pump 20 is provided at the rear part of the lower hull panel 14.

The jet pump 20 has a water channel 24. The channel 24 extends from a water intake opening 21 at the bottom of the boat, passes through a jet opening 22, and reaches a nozzle 30. An impeller 25 is located within the channel 24. A shaft 26 of the impeller 25 is coupled with an output shaft 17*a* of the engine 17. When the impeller 25 is driven by the engine 17, water, taken in through the water intake opening 21, is spurted out from the jet opening 22, via the nozzle 30, and the boat body 11 is propelled. The driving speed of the engine 17, and hence the force of propulsion by the jet pump 20, is controlled by rotating the throttle grip of the steering handlebar 13.

Figure 2:
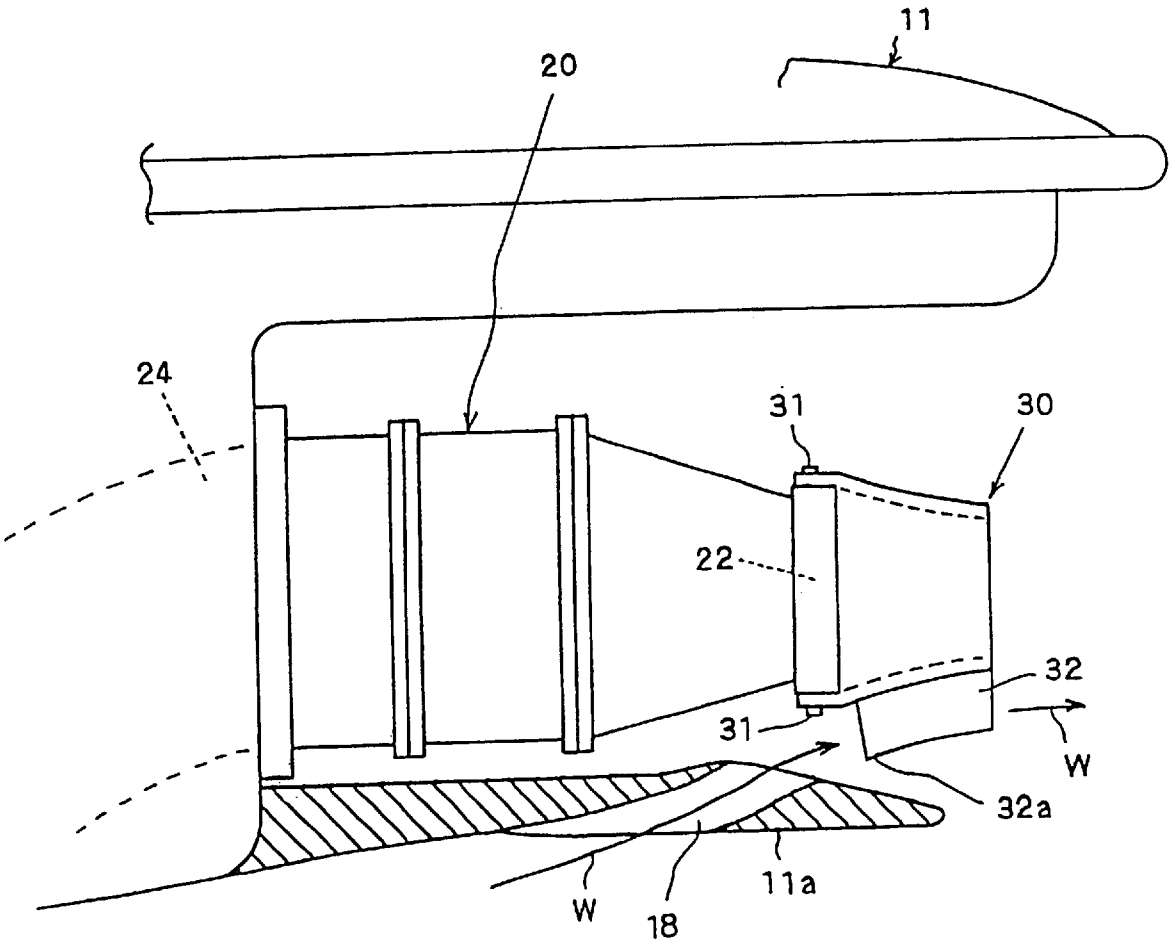
FIG. 2 is a partially cut-away, close-up, side view of parts in the vicinity of a nozzle, in accordance with the first embodiment.
Figure 3A:
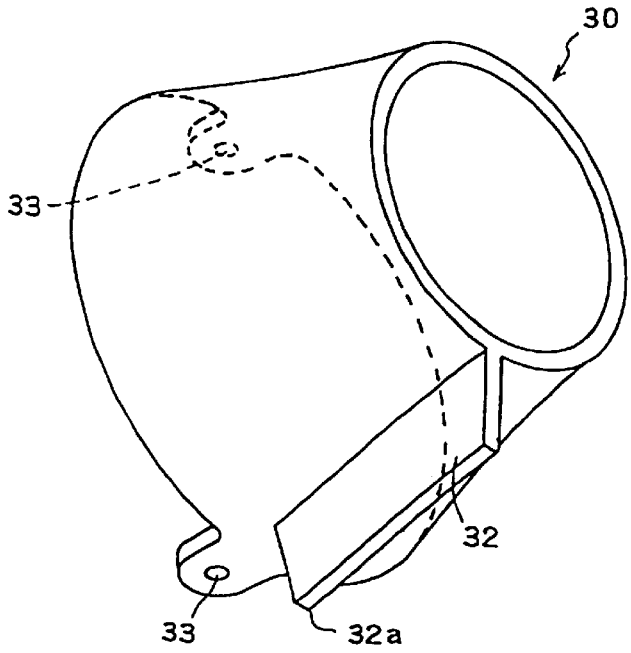
FIG. 3(*a*) is a perspective view of the nozzle, in accordance with the first embodiment.
Figure 3B:
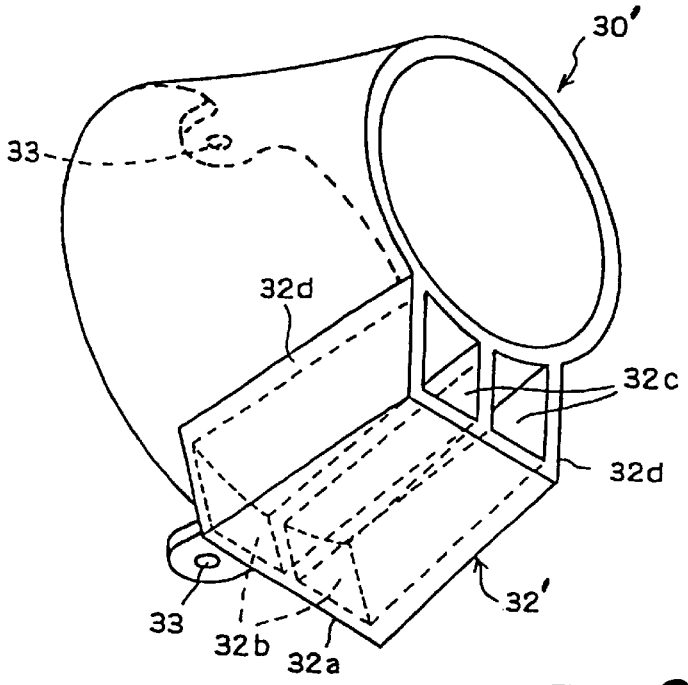

As shown in FIG. 2, the nozzle 30 can be rotated using a pair of upper and lower pins 31, 31 provided at the jet opening 22. A rudder 32 is formed integrally on a lower part of the outer surface of the nozzle 30. The rudder 32 of this embodiment is formed in a plate shape, as shown in FIG. 3(*a*). A lower end 32*a* of the rudder 32 does not project further down than a boat bottom 11*a* (refer to FIG. 1 and FIG. 2). As illustrated in FIG. 2, a rudder channel 18 for guiding a water flow W to the rudder 32 is provided at the boat bottom 11*a*. The rudder channel 18 is separate from the jet pump channel 24. In FIG. 3(*a*), numerals 33, 33 indicate insertion holes for the pins 31.

The nozzle 30 is coupled to the steering handlebar 13 by a steering cable (not shown), so that operating the steering handlebar 13 rotates the nozzle 30. The rudder 32, being fixed to the nozzle 30, also rotates together with the nozzle 30.

According to the above jet-propelled boat 10, the nozzle 30 of the jet pump 20 can be rotated. The course of the boat can therefore be changed by changing the direction of the jet stream as a result of rotating the nozzle 30 when the jet-propelled boat 10 is being propelled by the jet pump 20.

The rudder 32 is provided at the nozzle 30 in such a manner as to not project further downwards than the boat bottom 11*a*. The rudder channel 18 is provided separately from the jet pump channel 24 so as to guide a water flow W to the rudder 32. It is therefore possible to change course by changing the direction of the water flow W flowing through the rudder channel 18 using the rudder 32, while the boat body 11 is moving under its own momentum, due to the jet stream of the jet pump 20 being stopped or weak while the boat is stopped or decelerating.

According to the jet-propelled boat of the present invention, the water flow W is guided by a rudder channel 18, that is separate from the jet pump channel 24, even though the rudder 32 does not project lower down than the boat bottom 11*a*. It is therefore possible to change course when the boat body 11 is moving under its own momentum due to the jet stream of the jet pump being stopped or weak when the boat has stopped or is decelerating.

FIG. 3(*b*) is a perspective view of a nozzle 30', in accordance with a second embodiment of the present invention. Elements in FIG. 3(*b*) corresponding to the like elements of the first embodiment are given the same numerals.

The point of distinction of the second embodiment is that the rudder 32', provided integrally with the nozzle 30', is duct-shaped. Other aspects of the second embodiment are the same as for the first embodiment. With this configuration, water flow W (refer to FIG. 2) guided to the rudder 32' using the rudder channel 18 flows into the rudder 32' through inlets 32*b*, 32*b*, and flows out from the rudder 32' through outlets 32*c*, 32*c*. The direction of the water flow W can also be changed as a result of the water flow W colliding with one of side surfaces 32*d* of the rudder 32'.

The same operating results as were obtained for the first embodiment can therefore also be obtained for the second embodiment. Further, since the rudder 32' is duct-shaped, the direction of the water flow W, guided by the rudder channel 18, can be changed in a more effective manner, and dramatically superior performance can be achieved in the changing of course of the boat.

Figure 4:
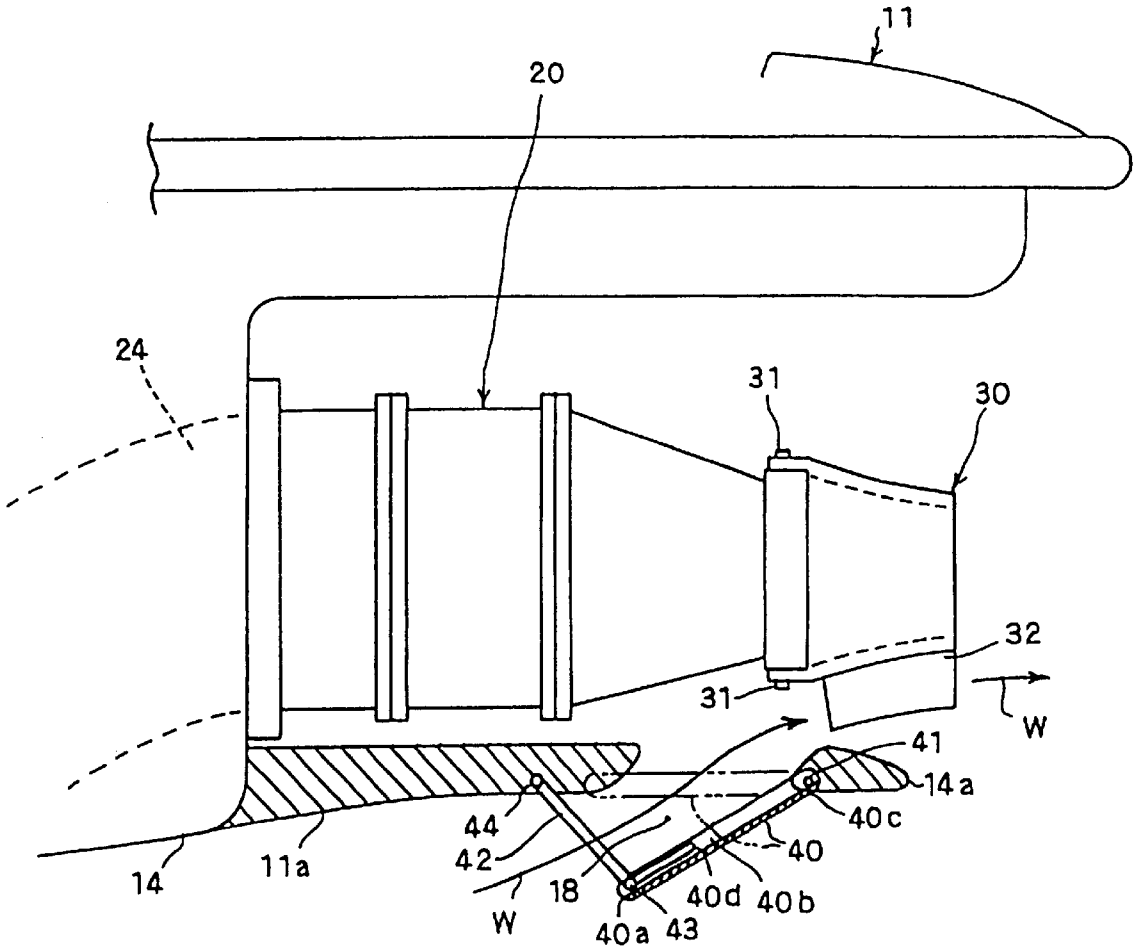
FIG. 4 is a partially cut-away, close-up, side view showing parts in the vicinity of a nozzle, in accordance with a third embodiment of the present invention.
Figure 5A:
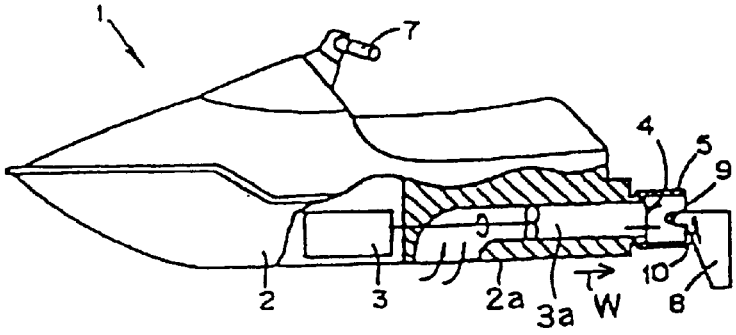
FIG. 5(a) BACKGROUND ART
FIGS. 5(*a*) is a partially cut-away, side view of a jet-propelled boat, in accordance with the background art.
Figure 5B:
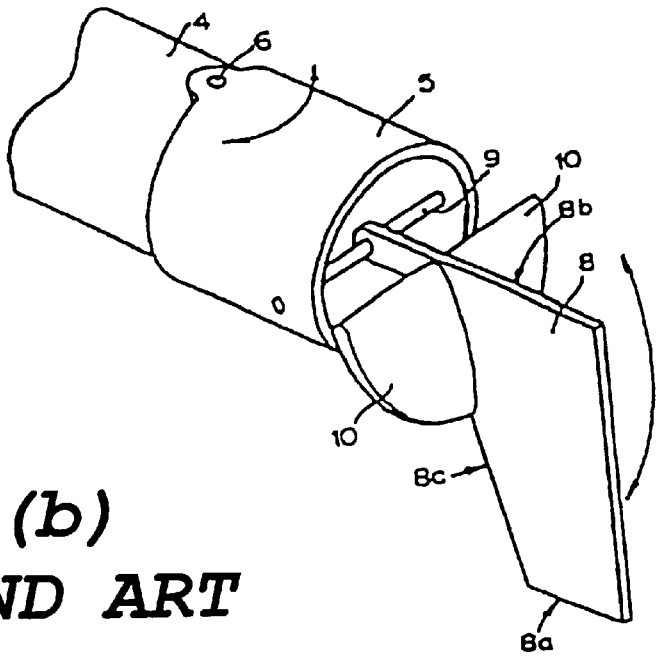
FIG. 5(b) BACKGROUND ART

FIG. 4 is a partially cut-away, close-up, side view showing parts in the vicinity of a nozzle, in accordance with a third embodiment of the present invention. Elements in FIG. 4 corresponding to like elements of the first and second embodiments are given the same numerals.

The point of distinction of the third embodiment is that the rudder channel 18 is formed of a watercourse plate 40. The watercourse plate 40 includes an end 40*a* located at a front with respect to a direction of travel, which opens away from the boat body 1 when driving of the jet pump 20 is halted or when a rotational speed of the jet pump 20 is a prescribed value or less. Other aspects of the third embodiment are the same as the first and second embodiments.

The watercourse plate 40 has side plates 40*b*, 40*b* (only one side plate 40*b* is shown in FIG. 4) on the left and right sides in the direction of travel of the jet-propelled boat 10.

Rear ends 40*c* of the side plates 40*b*, 40*b* are rotatably connected to the rear end 14*a* of the lower panel 14 using a shaft 41. Long holes 40*d* are provided at the front part of the side plates 40*b* and ends of links 42, 42 (only one link 42 is shown) are coupled to the long holes 40*d* in such a manner as to be able to move along the long holes 40*d*. The bases (other ends) of the links 42 are rotatably connected to the lower hull panel 14 using a shaft 44.

The links 42 and the watercourse plate 40 are coupled to the throttle grip of the steering handlebar 13 using an appropriate coupling mechanism (for example, a steering cable, etc., not shown). When the throttle grip is returned completely, or when the angle of rotation is less than a prescribed angle (i.e., when the driving of the jet pump 20 is stopped or when the drive speed of the jet pump 20 is a prescribed value or less), the watercourse plate 40 is located as shown by the solid lines in FIG. 4, and the end 40*a* opens in a direction away from the boat body 11. When the throttle grip is rotated to a prescribed angle or greater (i.e., when the drive speed of the jet pump 20 is a prescribed value or greater), the watercourse plate 40 closes, so as to make close contact with or be in close proximity to the boat bottom 11*a*, as shown by the dotted lines in FIG. 4. The same operating results as were obtained for the first and second embodiments can therefore also be obtained for the third embodiment.

According to the jet-propelled boat of the third embodiment, the rudder channel 18 is formed of a watercourse plate 40 with an end 40*a* at the front, with respect to a direction of travel, opening away from a boat body 11 when driving of the jet pump 20 is halted or when a rotational speed of driving of the jet pump 20 is a prescribed value or less. This watercourse plate 40 therefore forms the rudder channel 18 while simultaneously acting as a resistance plate while the boat is moving under its own inertia (when the jet stream of the jet pump is stopped or weak) when the boat is stopped or decelerating. The watercourse plate 40 therefore acts as a resistance plate to assist the boat 10 in stopping rapidly or slowing down rapidly. Further, it is possible to change course in a superior manner when the boat comes to a halt rapidly or decelerates rapidly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A jet-propelled boat comprising:

a boat hull;

a first water channel located adjacent a lower portion of said boat hull;

a jet pump located in said water channel;

a nozzle having a water input, a water output and an outer surface formed between said input and said output, said nozzle being located at an end of said water channel, and said nozzle including a rudder attached to said outer surface of said nozzle; and a second water channel separate from said first water channel, said second water channel directing a water flow toward said rudder.

2. The boat according to claim 1, wherein said rudder projects no further downwards than a bottom of said boat hull.

3. The boat according to claim 1, wherein said first water channel starts at a first water inlet located adjacent said lower portion of said boat hull, and wherein said second water channel starts at a second water inlet, separate from said first water inlet, located adjacent said lower portion of said boat hull.

4. The boat according to claim 3, further comprising:

a plate moveably attached to said lower portion of said boat hull, said plate being provided to selective block or open said second water inlet.

5. The boat according to claim 4, wherein said second water inlet is opened when a driving speed of said jet pump is a predetermined value or less.

6. The boat according to claim 5, wherein said rudder projects no further downwards than a bottom of said boat hull.

7. The boat according to claim 4, wherein said plate is rotatably attached to said lower portion of said boat hull at a rear end of said plate, taken in a direction of travel of said boat, and wherein a front end of said plate moves away from said lower portion of said boat hull while said rear end of said plate rotates relative to said lower portion of said boat hull, resulting in said second water inlet being opened.

8. The boat according to claim 7, wherein said rudder projects no further downwards than a bottom of said boat hull.

9. The boat according to claim 7, wherein said second water inlet is opened when a driving speed of said jet pump is a predetermined value or less.

10. The boat according to claim 4, wherein said rudder projects no further downwards than a bottom of said boat hull.

11. The boat according to claim 3, wherein said rudder projects no further downwards than a bottom of said boat hull.

12. The boat according to claim 1, wherein said rudder is rigidly fixed to a lower portion of said outer surface of said nozzle.

13. The boat according to claim 1, wherein said rudder is a planar fin projecting away from said outer surface of said nozzle.

14. The boat according to claim 13, wherein said rudder projects no further downwards than a bottom of said boat hull.

15. The boat according to claim 1, wherein said rudder includes a first water duct fixed to said outer surface of said nozzle.

16. The boat according to claim 15, wherein said rudder includes a second water duct fixed to said outer surface of said nozzle, and extending in a direction which is substantially parallel to an extension direction of said first water duct.

17. A jet-propelled boat comprising:

a boat hull;

a first water channel located adjacent a lower portion of said boat hull;

a jet pump located in said water channel;

a nozzle having a water input, a water output and an outer surface formed between said input and said output, said nozzle being located at an end of said water channel, and said nozzle including a rudder attached thereto, wherein said rudder projects no further downwards than a bottom of said boat hull; and a second water channel separate from said first water channel, said second water channel directing a water flow toward said rudder, wherein said first water channel starts at a first water inlet located adjacent said lower portion of said boat hull, and wherein said second water channel starts at a second water inlet, separate from said first water inlet, located adjacent said lower portion of said boat hull.

18. The boat according to claim 17, further comprising:

a plate moveably attached to said lower portion of said boat hull, said plate being provided to selective block or open said second water inlet, wherein said second water inlet is opened when a driving speed of said jet pump is a predetermined value or less.

19. The boat according to claim 18, wherein said rudder is one of a planar fin fixed to and projecting away from an outer surface of said nozzle, and a first water duct fixed to an outer surface of said nozzle.

20. The boat according to claim 17, wherein said rudder is one of a planar fin fixed to and projecting away from an outer surface of said nozzle, and a first water duct fixed to an outer surface of said nozzle.

* * * * *